United States Patent [19]

Pascher

[11] Patent Number: 4,822,955

[45] Date of Patent: Apr. 18, 1989

[54] CABLE WITH A CORE SURROUNDED BY A BAND HAVING TENSILE ELEMENTS

[75] Inventor: Helmut Pascher, Munich, Fed. Rep. of Germany

[73] Assignee: Siemens Aktiengesellschaft, Berlin and Munich, Fed. Rep. of Germany

[21] Appl. No.: 162,962

[22] Filed: Mar. 2, 1988

[30] Foreign Application Priority Data

Mar. 13, 1987 [DE] Fed. Rep. of Germany ..... 3708283

[51] Int. Cl.[4] ..... H01B 7/18

[52] U.S. Cl. ..... 174/102 R; 174/102 SP; 174/102 D; 174/106 R; 174/107; 174/131 R; 350/96.23

[58] Field of Search ..... 174/102 R, 102 SP, 102 D, 174/70 C, 70 A, 107, 113 C, 106 R, 126 CS, 131 A, 131 R; 350/96.23

[56] References Cited

U.S. PATENT DOCUMENTS

| | | | |
|---|---|---|---|
| 2,338,304 | 1/1944 | Schmied | 174/102 SP |
| 2,870,792 | 1/1959 | Penrose | 174/102 D |
| 3,582,536 | 6/1971 | Miller | 174/102 D |
| 4,157,452 | 6/1979 | Pignataro et al. | 174/107 X |
| 4,730,894 | 3/1988 | Arroyo | 350/96.23 |

FOREIGN PATENT DOCUMENTS

| | | | |
|---|---|---|---|
| 2913054 | 10/1980 | Fed. Rep. of Germany . | |
| 80/001517 | 7/1980 | PCT Int'l Appl. | 350/96.23 |
| 420885 | 9/1933 | United Kingdom | 174/10 |
| 574926 | 1/1946 | United Kingdom | 174/131 A |
| 1387991 | 3/1975 | United Kingdom | 174/102 SP |
| 2106266 | 4/1983 | United Kingdom | 350/96.23 |

*Primary Examiner*—Morris H. Nimmo

*Attorney, Agent, or Firm*—Hill, Van Santen, Steadman & Simpson

[57] ABSTRACT

A cable, which has a cable core surrounded by a band which has been provided with tensile elements, has an improvement with the tensile elements being wound on the band to extend obliquely to the longitudinal edges of the band and to the axis of the cable.

16 Claims, 1 Drawing Sheet

CABLE WITH A CORE SURROUNDED BY A BAND HAVING TENSILE ELEMENTS

BACKGROUND OF THE INVENTION

The present invention is directed to a cable having a cable core with a band or strip wrapped to enclose the core and the band being provided with tensile elements which are connected to the band in a mechanical firm fashion.

German Published Application No. 29 13 054 discloses a cable having a band which is wrapped around a core. The band or strip of the patent is formed of a double thickness of foil which encloses tensile elements imposed between the two layers. These tensile elements run or extend parallel to one longitudinal edge of the foil so that the longitudinal axis of the tensile elements proceeds parallel to the longitudinal axis of the band and the cable when the strip or band has been wrapped onto the cable with its longitudinal edges extending parallel to the axis of the cable.

The arrangement of the tensile elements in this way to extend parallel to the longitudinal axis of the cable or parallel to the edges of the band has the disadvantage that, when the cable is bent, its arc-inner zone is compressed because the length of the arc-outer zone is kept constant by the tensile elements which are fixed thereover for the entire arc so the dislocation of the neutral bending zone will occur. The average length of the cable is thus shortened during the bending. Given light waveguides, which are component parts of the cable, this compression can lead to a measurable increase in the attenuation of the light waveguides. In special instances, it can even lead to a fiber breakage.

The band, which has longitudinally embedded tensile elements, can be helically placed or wrapped around a cable core in order to avoid the above-mentioned disadvantage. However, the band and cladding are now more difficult to remove to gain access to the core.

SUMMARY OF THE INVENTION

The present invention is directed to an object of modifying the tensile band so that it can be placed around the cable core parallel to the axis and the tensile elements contained in the band thereby nonetheless come to lie essentially helically around the core.

The object is that the tensile elements will behave like a conventionally applied armoring or sheath so that whenever the cable is bent, the length compensation between the arc-inner and the arc-outer sections occurs inside each and every individual element so that the length of the cable axis is preserved and no dislocation of the neutral bending zone will occur.

To accomplish these goals, the present invention is directed an improvement in the cable having a cable core with a longitudinal axis, an elongated band having longitudinal edges, a plurality of tensile elements being connected to the band, said band and tensile elements being wrapped on the core with the edges of the band being adjacent each other and extending parallel to the axis of the core. The improvements comprise the tensile elements being applied to the band to extend obliquely relative to the longitudinal edges of the band.

The advantage of this structure comprises first and foremost that the tensile band can already be present in a prefabricated form and can be longitudinally applied in a simple way when the cable is cladded and can be again be removed just as easily when the cable is mounted or assembled without having to enter into any compromises with respect to the bending properties of the cable. The manufacture of the cable is simplified in that no apparatus that rotates around the cable axis for the application of the band or strip to the cable core is required.

When a rip wire or thread is additionally introduced to extend parallel to the axis between the longitudinal edges of the band or at the butt joint when the band is just equal to the circumference of the core, then the cladding can be parted in a particularly simple way upon assembly of the cable and can be stripped off in a very simple way together with the band which lies therebelow.

Additional advantages and features of the invention are relatively apparent from the following description of the drawings, the preferred embodiments, and the claims.

DESCRIPTION OF THE PREFERRED EMBODIMENTS

Figure 1:
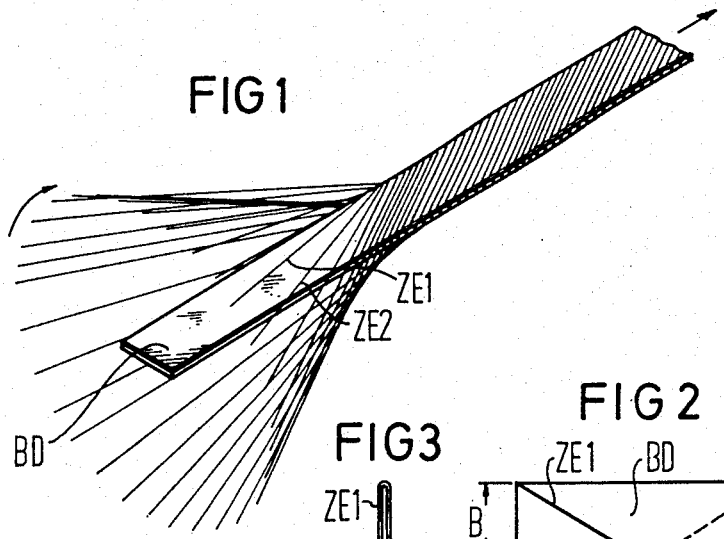
FIG. 1 is a view of a band with tensile elements wrapped thereon in accordance with the present invention.
Figure 6:
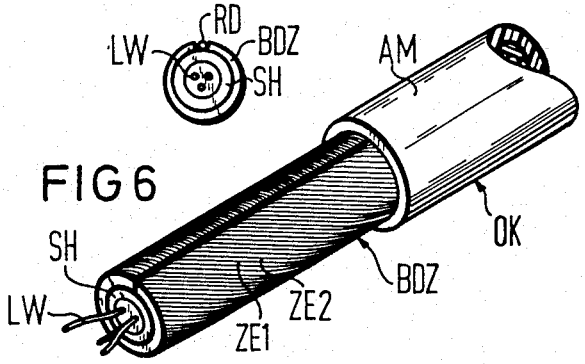
FIG. 6 is a perspective view of the finished cable constructed in accordance with FIG. 5 with a cladding applied to a portion of the cable.

Principles of the present invention are particularly useful when incorporated in a cable generally indicated at OK in FIG. 6. To form the cable OK, a band BD (FIG. 1) is provided and preferably has a rectangular cross-section with two parallel longitudinally extending edges. The band BD can be composed of a metal or a plastic material The wall thickness of the band should be selected to be in a range of between 0.5 and 1 mm. This thickness should be such that it is still possible to wrap the band around a cable core in any case with the longitudinal edges coming into engagement with each other.

A large number of tensile elements ZE1, ZE2, etc. are provided and these may be threads, yarns or wires whose diameter is expediently selected to be in a range of between 0.1 and 0.5 mm. The tensile elements ZE1, ZE2, etc. are continuously wound onto the band BD in a long lay, i.e., are practically stranded thereto so that the tensile elements ZE1 and ZE2 are each correspondingly bent over the band edges in order to introduce a directional change of 180°.

Figure 2:
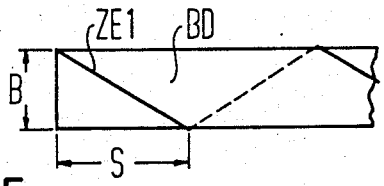
FIG. 2 is a side view of the band wrapped with a tensile element.
Figure 3:
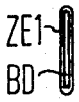
FIG. 3 is an end view of the band of FIG. 2.

For purposes of illustration, the band BD is shown in FIG. 2 with the width of the band being B. The size of the width B depends on the anticipated outside diameter of the cable core and should be selected so that the longitudinal proceeding outside edges of the band just still touch or do not overlap insofar as possible. In the case of the band BD, a tensile element ZE1 is shown schematically and this just extends from one edge to the opposite edge to provide a "length of lay" with a length of S for the band BD. The "length of lay" S is expediently selected with reference to the width B of the band so that S/B lies in the range of values of between 5 and 40. Thus, the value of S will be at least 5B and not more than 40B.

Figure 4:
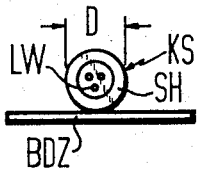
FIG. 4 is an end view of a cable core with the band prior to wrapping the band onto the core.

When the band BD is wound with the tensile elements, it forms a finished band BDZ which, are illustrated in FIG. 4, has a rectangular cross-section. The band BDZ is wrapped around a cable core KS, which comprises a protective sheath SH and whose inside contains appropriate conducting elements, for example, in the form of light waveguides LW or in the form of electrical leads. When the band BDZ of FIG. 4 with the tensile elements is wrapped around the cable core KS, the structure shown in FIG. 5 will occur with the edges of the band BDZ extending very close to one another or respectively just touching.

Figure 5:
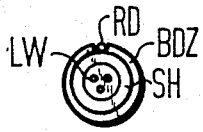
FIG. 5 is an end view of a cable core having the band with the tensile elements wrapped thereon.

In order to guarantee an adequate longitudinal tightness of the cable OK, it is possible to coat the band BDZ with a water repelling filling compound. For improved transmission of tensile forces on to the outside cladding AM, the tensile element ZE1, ZE2 on the outside of the band BDZ can be connected to the cladding AM with a hot melt adhesive coating over the entire surface or part thereof. If part, the coating extends either longitudinally or transversely. If transversely, it expediently has a period of the length of lay S. In order to simplifythe stripping of the cladding AM, a rip wire RD can be provided under the cladding AM in the gap between the edges of the band or in the band gap, i.e., between the edges of the rolled up band BDZ as illustrated in FIG. 5.

As best illustrated in FIG. 6, a type of SZ length of lay having 5 through 20 times the width B of the band BDZ will occur overall. The width of the band BD corresponds to the outside circumference of the cable core KS which has a diameter D. In other words, in the illustrated embodiment, the cable core KS has an outer sheath SH so that the width of the band is equal to the outer circumference of the protective sheath SH. Thus, the band BDZ has a width which is equal to approximately $\pi D$.

When all of the yarns in the cable absorb a longitudinal tensile force F together and their length of lay S is equal to n-fold multiple of the band width B which is approximately $\pi D$, a cross-contraction force f acting on the band occurs per length unit. This force f is calculated by the following formula:

$$f=F/n^2 B$$

In accordance with the above equation, f=6.7 N/cm with, for example, F=2 kN, B=3 cm which corresponds to a diameter D=0.96 cm, and n=10, so that S=30 cm. A thin band BD of aluminum or of a not all too soft plastic selected from HDPE, PP or PT which is tightly embedded between the cladding and the protective sheath of the core can withstand this load without further ado. This is even possible when the band BD is transversely grooved or additionally perforated for better flexibility of the cable.

In order to suppress a lift-off of the tensile elements ZE1, ZE2, etc. when forming the band BD during the cladding operation, i.e., during the application of the outside cladding AM according to FIG. 6, the tensile elements ZE1 and ZE2 can be bonded line-like to the inside of the band BD with a hot melt adhesive coating.

Figure 7:
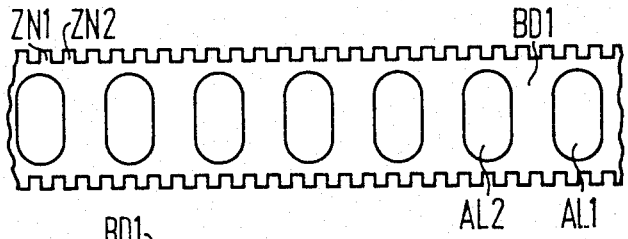
FIG. 7 is a plan view of a modification of the band in accordance with the present invention.
Figure 8:
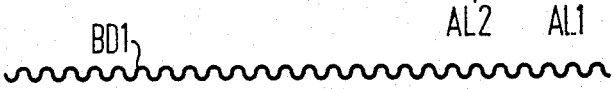
FIG. 8 is a side view of a modification of the band of FIG. 7.

In order to prove flexibility, the band can have a different structure such as the band BD1 of FIG. 7. In FIG. 7, the band BD1 has a series of punched, longitudinally spaced oval holes AL1 and AL2. As illustrated in FIG. 8, the band BD1 in addition has been corrugated to provide transversely extending grooves relative to the longitudinal axis. It should be pointed out that either the holes or corrugating can be used to form means for increasing flexibility of the band or can be used together.

Instead of or in addition to the application of the hot melt adhesive to form means for fixing the elements on the band, a longitudinal slip of the tensile elements on the band can also be rendered more difficult by providing slight indentations ZN1, ZN2 on each of the longitudinal band edges as illustrated in FIG. 7.

Although various minor modifications may be suggested by those versed in the art, it should be understood that I wish to embody within the scope of the patent granted hereon all such modifications as reasonably and properly come within the scope of my contribution of the art.

I claim:

1. In a cable having a cable core with a longitudinal axis, an elongated band having elongated edges, a plurality of tensile elements being connected to said band, said band and tensile elements being wrapped on the core with the edges of the band being adjacent to each other and extending parallel to the longitudinal axis of the core, the improvement comprising the tensile elements being wound onto the band to extend obliquely relative to the longitudinal edges of the band, to extend on both sides of the band and to be bent over the edges of said band.

2. In a cable according to claim 1, wherein the tensile elements are wound on the band with a finite length of lay.

3. In a cable according to claim 2, wherein the length of lay leading from one longitudinal band edge to the other longitudinal band edge is selected with reference to a width of the band so that the length of lay has a value of not less than 5 times the width of the band and not greater than 40 times the width of the band.

4. In a cable according to claim 1, wherein the width of the band is selected relative to the diameter of the cable core so that the band edges are in an immediate proximity to one another when the band is applied to the core.

5. In a cable core according to claim 4, wherein the width is selected so that the longitudinal edges touch one another when the band is wrapped onto the cable core.

6. In a cable according to claim 1, wherein the band has a plurality of longitudinally spaced continuous perforations.

7. In a cable according to claim 1, wherein the band is a band with corrugations extending transverse to the longitudinal edges.

8. In a cable according to claim 1, wherein the band and tensile elements have means for affixing the tensile elements to the band.

9. In a cable according to claim 8, wherein the means for affixing is an adhesive material.

10. In a cable according to claim 8, wherein the means for affixing are indentations on the longitudinal edges of the band.

11. In a cable according to claim 1, which includes a cable cladding surrounding the band on the cable core and a layer of hot melt adhesive extending between the cable cladding and the band.

12. In a cable according to claim 1, wherein the band has means for increasing the flexibility of the band.

13. In a cable according to claim 12, wherein said means for increasing the flexibility includes a plurality of longitudinally spaced perforations in the band.

14. In a cable according to claim 13, wherein the means for increasing flexibility includes the band being corrugated to provide transverse grooves relative to the longitudinal edges.

15. In a cable according to claim 12, wherein the means for increasing flexibility includes transverse corrugation of the band relative to the longitudinal edges.

16. In a cable according to claim 1, wherein the width of the band is selected relative to the diameter of the cable core so that the band edges have a gap extending therebetween, and said cable includes a rip wire being arranged in said gap.

* * * * *